United States Patent [19]

Dattilo et al.

[11] 4,305,652

[45] Dec. 15, 1981

[54] MERGING OF INFORMATION IN A COPIER-PRINTER SYSTEM

[75] Inventors: Anthony J. Dattilo, Longmont; Carl A. Queener, Lyons; John M. Woodward, Boulder, all of Colo.

[73] Assignee: International Business Machines Corporation, Armonk, N.Y.

[21] Appl. No.: 95,481

[22] Filed: Nov. 19, 1979

[51] Int. Cl.[3] ..... G03G 15/00

[52] U.S. Cl. ..... 355/6; 355/77

[58] Field of Search ..... 355/7, 3 R, 6, 23–26, 355/35 H, 14 SH, 77; 101/DIG. 13

[56] References Cited

U.S. PATENT DOCUMENTS

| | | | |
|---|---|---|---|
| 2,901,246 | 8/1959 | Wagner | 271/3 |
| 3,744,899 | 7/1973 | Sable | 355/13 X |
| 3,750,189 | 7/1973 | Fleischer | 346/74 ES |
| 3,898,627 | 8/1975 | Hooker et al. | 340/172.5 |
| 3,936,180 | 2/1976 | Willard et al. | 355/14 R |
| 3,949,159 | 4/1976 | Ricards et al. | 178/6.6 B |
| 3,964,591 | 6/1976 | Hill et al. | 197/1 R |
| 4,000,486 | 12/1976 | Schomburg | 340/172.5 |
| 4,044,232 | 8/1977 | Hubbard | 235/925 B |
| 4,046,471 | 9/1977 | Branham et al. | 355/14 R |
| 4,054,380 | 10/1977 | Donohue et al. | 355/14 R |
| 4,068,839 | 1/1978 | Bullock et al. | 271/180 |
| 4,089,516 | 5/1978 | Colglazier et al. | 271/9 |
| 4,116,558 | 9/1978 | Adamek et al. | 355/24 |
| 4,167,324 | 9/1979 | Wu | 355/7 X |

*Primary Examiner*—R. L. Moses

*Attorney, Agent, or Firm*—Fraser and Bogucki

[57] ABSTRACT

Non-coded and coded information are merged in a copier-printer system by copying the non-coded information onto one or more sheets of paper during a first pass of the sheets of paper through the system and thereafter selecting the sheets of paper with the non-coded information copied thereon from the secondary or duplex paper trays of the system for a second pass through the system during which coded information may be printed on the sheets of paper. Selection of the sheets of paper having non-coded information copied thereon is integrated with sheets of paper from the primary tray which are to contain exclusively coded information. Copying of the non-coded information and printing of the coded information is carried out under the control of mag cards indicating the pages and page locations within a given document where the non-coded information is to be copied and in some cases containing coded information to be integrated with the non-coded information.

In one method, non-coded information is copied on sheets of paper which are then electronically collated and inverted before being removed as a stack from the exit tray and placed upside down in the secondary tray for subsequent integration with sheets from the primary tray as coded information is printed. In an alternative method, the sheets of paper having non-coded information copied thereon are collected in the duplex tray with each sheet then being cycled through the system without copying or printing thereon so as to be inverted upon return to the duplex tray in preparation for printing of coded information. In a further alternative method, sheets of paper onto which the non-coded information has been copied are removed from the exit tray and thereafter selected from the secondary tray to make a complete set of copies which is thereafter used as originals to make further sets of copies.

15 Claims, 12 Drawing Figures

FIG. 7A
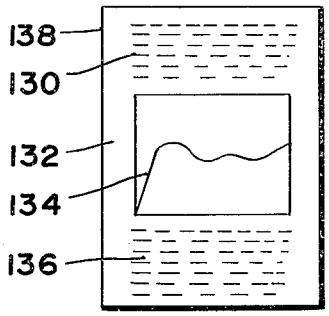
FIG. 7B
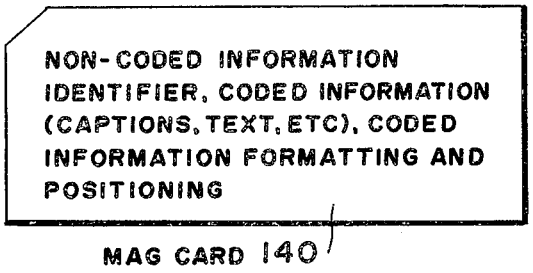
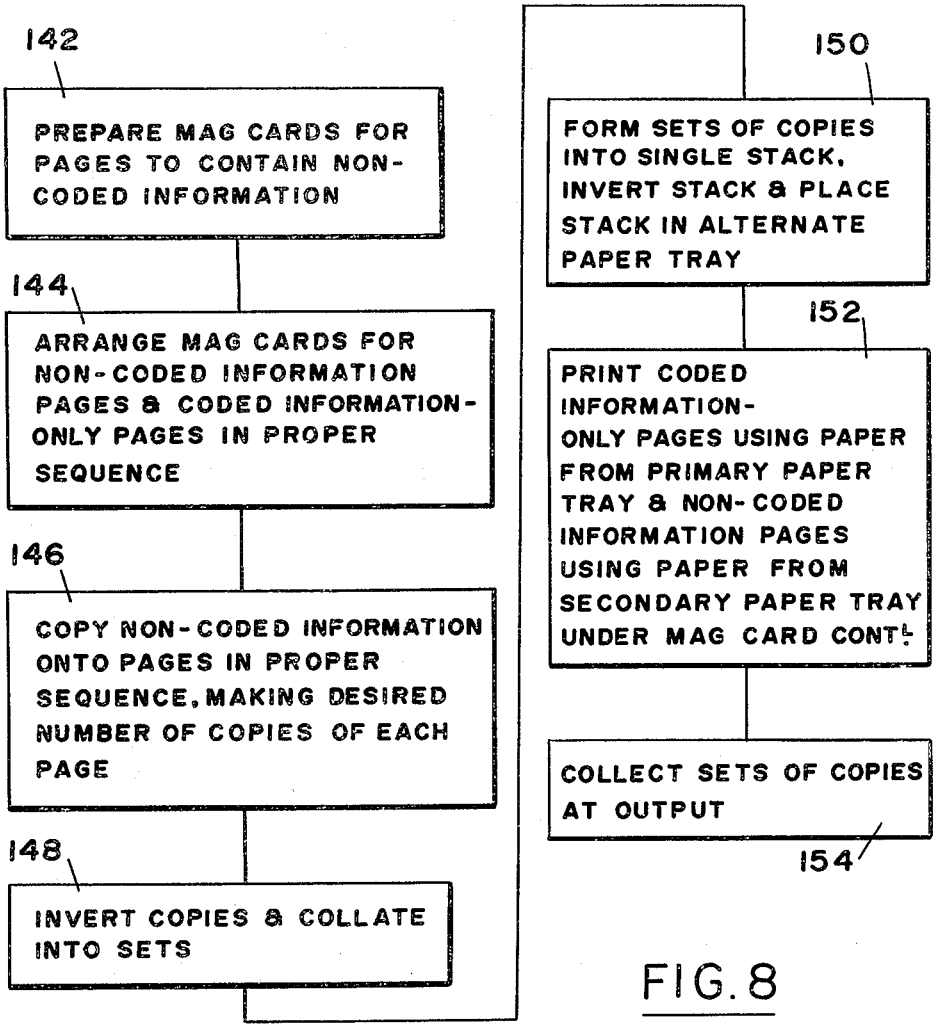
FIG. 8

FIG. 9
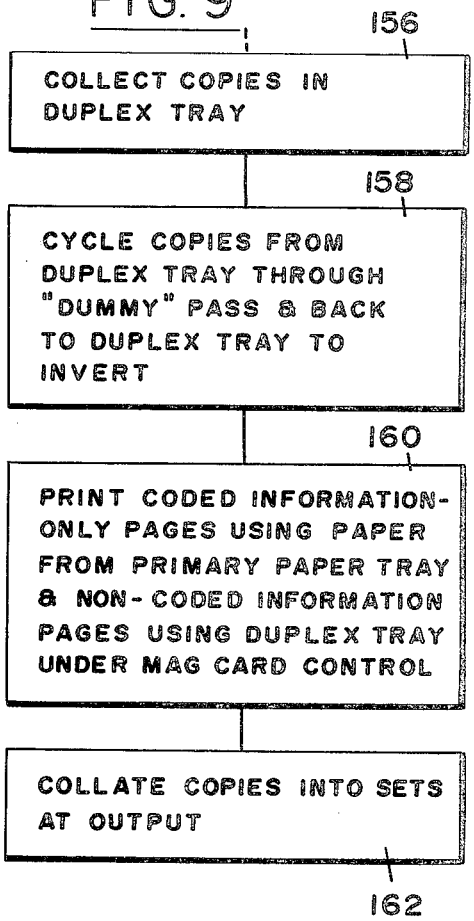
FIG. 10
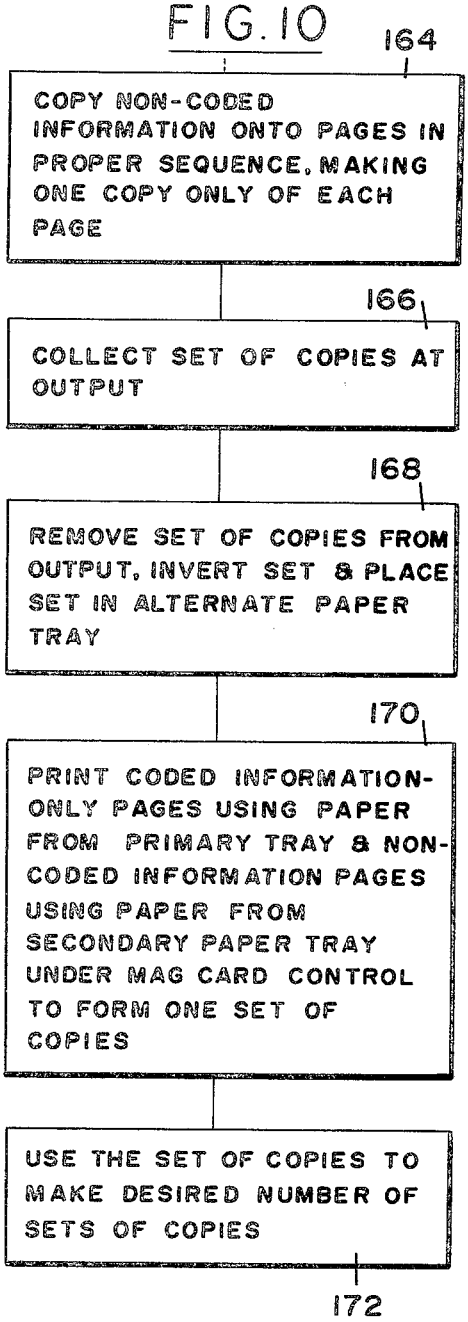
| | $T_1$ | $T_2$ | $T_3$ |
|---|---|---|---|
| EXAMPLE OF FIG. 8 | $P_3$ | $E_2$ | $O_1$ |
| | $P_2$ or $P_3$ | $E_1$ | $O_1$ |
| EXAMPLE OF FIG. 9 | $P_3$ | $E_2$ | $O_2$ |
| | $P_1$ | – | $O_2$ |
| | $P_1$ or $P_3$ | $E_1$ | $O_1$ |
| EXAMPLE OF FIG. 10 | $P_3$ | $E_2$ | $O_1$ |
| | $P_2$ or $P_3$ | $E_1$ | $O_1$ |
| | $P_3$ | $E_2$ | $O_1$ |
FIG. 11

MERGING OF INFORMATION IN A COPIER-PRINTER SYSTEM

BACKGROUND OF THE INVENTION

1. Field of the Invention

The present invention relates to copier-printer systems, and more particularly to systems capable of printing coded information as well as copying information from original documents onto sheets of paper using a xerographic or similar printing process.

2. History of the Prior Art

It is known to provide copier-printer systems which are capable of copying information from original documents onto sheets of paper and printing coded information on other sheets of paper using a xerographic or similar printing process. An example of such a system is provided by International Business Machines 6670 (IBM 6670) Copier-Printer System. A co-pending application of Roger E. Kuseski, Ser. No. 802,095, filed May 31, 1977, entitled Copy Production Machines and commonly assigned with the present application describes processor control of the IBM 6670 Copier-Printer system including control of the system during copying of non-coded information from original documents and during printing of coded information. Such copying and printing are carried out as separate and independent operations with one interrupting the other where necessary. Thus, there is no suggestion or description of how the non-coded information copied from original documents could be integrated with the printing of coded information to form a single document of one or more pages which combines the two different types of information. Such a capability would be most useful, for example, in the case of a document where charts, graphs or similar non-coded information is desired to be merged within the document and preferably within individual pages of the document with coded information which may consist of figure numbers, legends or other explanatory text in conjunction with the charts or graphs as well as other text.

Various other patents describe portions of the IBM 6670 Copier-Printer System and similar types of systems. Such patents include U.S. Pat. No. 4,046,471 of Branham et al which describes a copying capability in a laser printer, U.S. Pat. No. 4,000,486 of Schomburg which describes character generation and the use of a magnetic card reader and a page memory within a copier-printer system and U.S. Pat. No. 3,898,627 of Hooker et al which provides further description of character generation including laser image generation and serialization of data for printing. Patents which describe specific portions and features of copier-printer systems include U.S. Pat. No. 4,089,516 of Colgazier et al which describes a system having primary, secondary and duplex paper trays, U.S. Pat. No. 4,068,839 of Bullock et al which describes output bins and the manner in which paper can be inverted prior to entry into the bins and U.S. Pat. No. 4,044,232 of Hubbard which describes use of a duplex tray within a processor controlled copier-printer system. U.S. Pat. No. 4,054,380 of Donohue et al provides a further example of a processor controller copier-duplicator.

Still other patents which are of interest with respect to copier-printer systems include U.S. Pat. No. 3,949,145 of Ricards et al which discloses the merging of text from a computer or memory with illustrations physically stored in the device, U.S. Pat. No. 3,946,591 of Hill et al which shows a font selection for a printer where different fonts are stored in separate memories and selected during printing, U.S. Pat. No. 3,744,899 of Sable which discloses a method for printing variable data on documents and xerographically overprinting appropriate forms on the printed data in a second set, and U.S. Pat. No. 3,936,180 of Willard et al which describes a xerographic printing system having an additional input providing for overlay of forms.

As noted above it would be desirable to be able to merge different types of information in a copier-printer system so that, for example, non-coded information and coded information could be merged in a given document calling for both the copying of non-coded information and the printing of coded information. None of the systems and equipment therefor described by the above patents provide this capability.

Accordingly, it is an object of the invention to provide a method and apparatus for merging different types of information such as non-coded and coded information in a copier-printer system.

It is a further object of the invention to provide a method and apparatus in which non-coded information copied from original documents and coded information to be printed can be provided on different pages of a given document or even merged onto the same pages within the document using mostly available copier-printer hardware.

BRIEF DESCRIPTION OF THE INVENTION

Copier-printer systems in accordance with the invention merge different types of information in a given document by using different passes of the various sheets of paper of the document through the system to enter the different types of information. In the case where non-coded information copied from original documents is to be merged with printed matter produced by coded information, sheets of paper to have non-coded information copied thereon are first cycled through the system to copy the non-coded information thereon. Thereafter, the sheets of paper are placed in other than the primary paper tray such as in the secondary or duplex tray from which they are selected for integration with sheets of paper from the primary paper tray which are to have exclusively coded information printed thereon. The sheets of paper selected from the secondary or duplex paper trays undergo a second pass through the system, during which time coded information can be printed thereon. Merging of non-coded and coded information on the sheets of paper of the document is controlled by a mag card reader in conjunction with the processor control of the copier-printer system. Magnetic cards are prepared so as to contain indications of non-coded information and the locations of such information on specific pages within the document. The cards may also contain some or all of the coded information to be printed in the document. Non-coded information is then copied during the first pass of certain pages of the document through the system, following which the magnetic cards are used to select paper from the different trays for printing of the coded information thereon.

In one preferred method of preparing a document having non-coded information merged with coded information in accordance with the invention, sheets of paper are cycled through the copier-printer system to copy non-coded information thereon from original documents. The sheets of paper are electronically collated to provide the required number of sets of copies with each sheet being inverted by the system just prior to entry of the sheet into the output bin. The resulting stack of paper sheets in the output bin having the toner side on top is then removed from the output bin, inverted and placed toner side down in the secondary tray. The process then continues with printing of coded informaton. Pages of the document comprised exclusively of coded information are printed on sheets of paper taken from the primary paper tray. The sheets of paper stored in the secondary paper tray and which have non-coded information previously copied thereon are selected under mag card control so as to be properly integrated with the sheets of paper taken from the primary paper tray. Upon selection of each sheet of paper from the secondary paper tray for a second pass thereof through the system, coded information is printed thereon as dictated by the magnetic cards.

In a second method according to the invention the desired number of copies of each page to contain non-coded information are made and collected in the duplex tray. The sheets of paper are collected in the duplex tray so that the toner side of each sheet is up and so that copies of the first page are on top, copies of the second page are thereunder and so on. The sheets of paper in the duplex tray are then integrated with sheets of paper from the primary paper tray as the coded data is printed. Each sheet of paper stored in the duplex tray upon being selected is first run through a dummy cycle of the system without copying or printing thereon simply to invert the sheet, following which the sheet is again cycled through the system with coded information being printed thereon as required. The dummy cycle can be avoided where desired by use of paper inserting apparatus in the paper path upstream of the duplex tray.

In a further method in accordance with the invention one copy of each page to have non-coded information copied thereon is made. The resulting copies are removed from the exit tray and placed toner side down in the secondary tray. One complete set of copies is then made by selecting paper from the primary and secondary trays and printing coded information thereon in the manner previously described. This complete set of copies is then used as originals to make the required number of sets of copies which are collected in the mechanical collator of the system.

BRIEF DESCRIPTION OF THE DRAWINGS

The foregoing and other objects, features and advantages of the invention will be apparent from the following more particular description of preferred embodiments of the invention, as illustrated in the accompanying drawings, in which:

FIG. 7A illustrates a typical page of a document having non-coded and coded information merged thereon;

FIG. 7B illustrates the information contained on certain magnetic cards used in accordance with the invention;

FIG. 8 is a block diagram of the successive steps of a first method in accordance with the invention;

FIG. 9 is a block diagram of some of the successive steps of a second method in accordance with the invention;

FIG. 10 is a block diagram of some of the successive steps of a third method in accordance with the invention; and FIG. 11 is a table setting forth the various functions performed by the controller of FIG. 6 in carrying out the methods of FIGS. 8–10.

DETAILED DESCRIPTION

Figure 1:
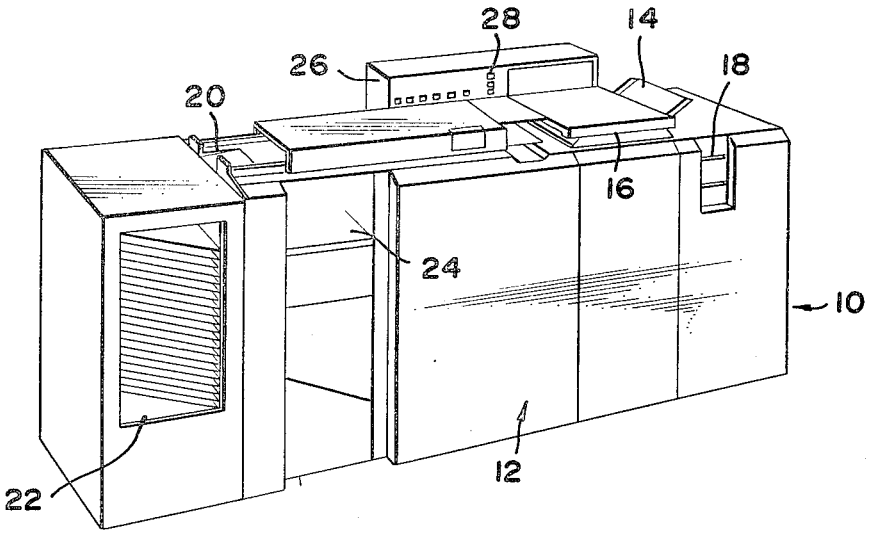
FIG. 1 is a perspective view of a copier-printer system in accordance with the invention.
Figure 2:
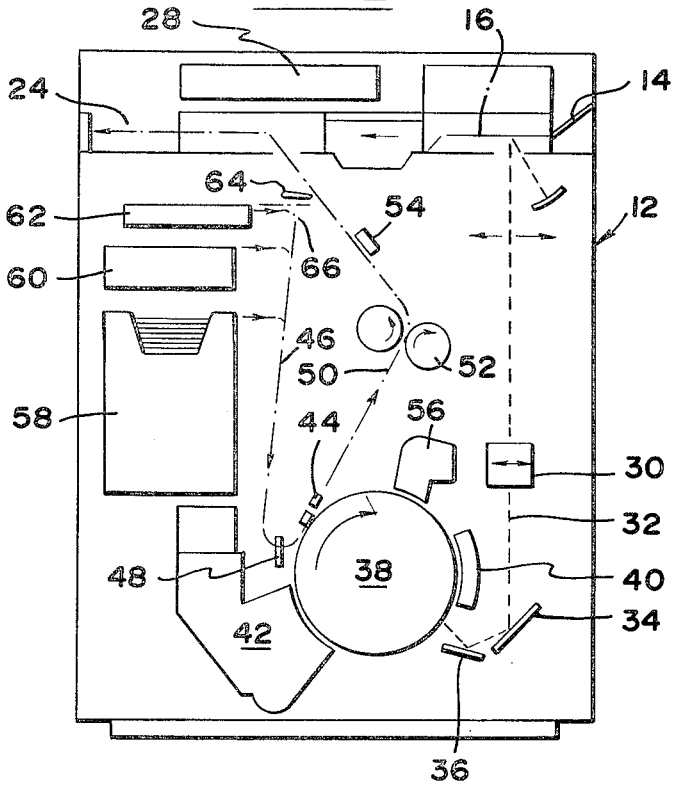
FIG. 2 is a front view of a portion of the inside of the system of FIG. 1.
Figure 3:
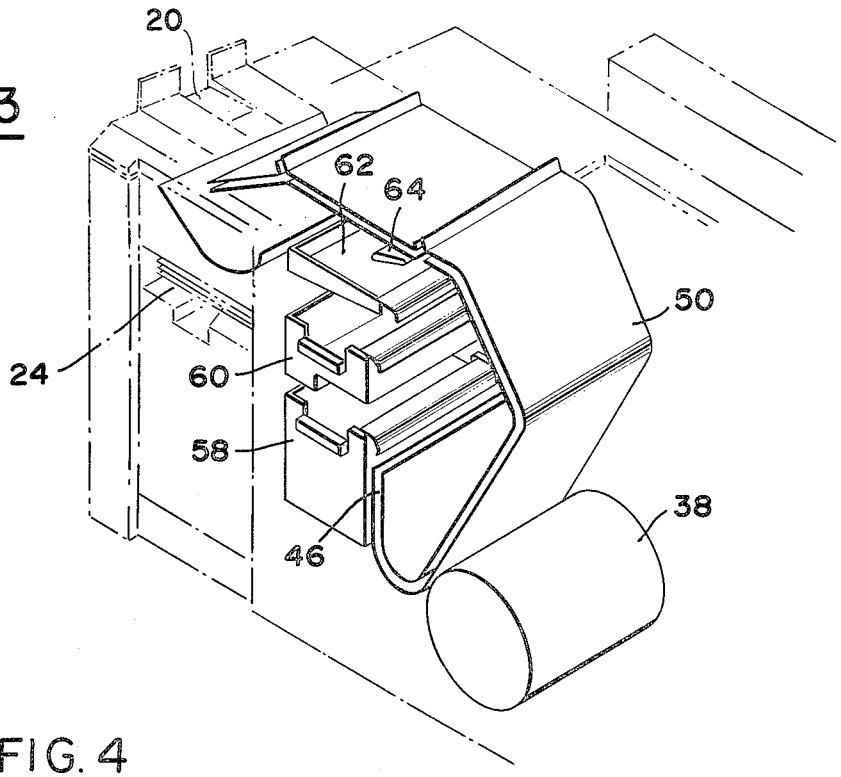
FIG. 3 is a perspective view of a portion of the inside of the system of FIG. 1.
Figure 4:
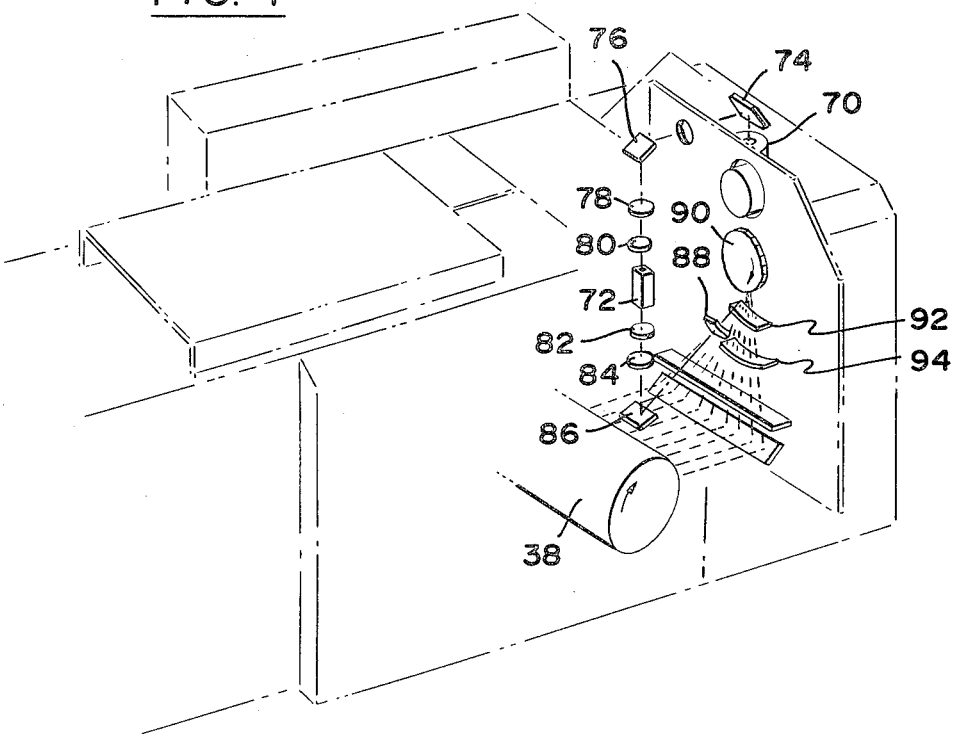
FIG. 4 is a further perspective view of a portion of the inside of the system of FIG. 1.

FIG. 1 depicts a copier-printer system 10 which in the present example comprises an IBM 6670 system modified in accordance with the invention. Various portions of the IBM 6670 system are described in detail in the previously referred to co-pending application of Kuseski and in some of the previously referred patents including the patents to Branham et al, Schomburg and Hooker et al. As seen in FIG. 1 the copier-printer system 10 includes a copy-print production machine 12 which is shown in FIGS. 2–4 and which includes various paper supply trays and apparatus including a rotating drum and scanning laser beam for copying or printing on the paper. A document feed 14 may be used to feed documents to a document glass 16 from which they are scanned in order to produce a copy thereof within the copy-print production machine 12. The copy-print production machine 12 is also operative to print coded data entered in the copier-printer system 10 such as from one or more magnetic cards in a card unit 18.

Copies of documents fed to the document glass 16 are passed by the copy-print production machine 12 to a copy exit tray 20 or to a mechanical collator 22. Where several copies of a multi-page document are being made, the mechanical collator 22 functions in well known fashion to collate the copies into sets. With the mechanical collator 22 turned off, the copies are delivered to the exit tray 20. When the copy-print production machine 12 is used to print coded information on sheets of paper from one of the paper supply trays, such sheets of paper are normally routed to a dual exit pocket 24 adjacent the copy exit tray 20 and the mechanical collator 22. The dual exit pocket 24 is normally all that is required for an output gathering device in the case of copying because of the electronic collation capability of the copier-printer system 10. As described hereafter, the successive pages of a document can be stored in a non-volatile store and used to make a selected number of copy sets.

The copier-printer system 10 has a control panel 26 mounted on top and capable of controlling the various copying and printing functions of the system. The control panel 26 includes a quantity selector 28 used to select the number of copies to be made of a particular document at the document glass 16.

FIGS. 2–4 depict some of the details of the copyprint production machine 12 within the copier-printer system 10. Referring to FIG. 2, a document placed on the document glass 16 is scanned by a moving lens 30 and the resulting beam 32 is reflected by mirrors 34 and 36 onto a drum 38. When the copier-printer system 10 is being used to print instead of copy, the beam 32 reflected from the document on the document glass 16 is replaced by a laser beam from apparatus shown and described in connection with FIG. 4. The drum 38 comprises a photoconductor drum which rotates in the direction of the arrow past a plurality of xerographic processing stations. A first such station 40 imposes either a positive or negative electrostatic charge on the surface of the drum 38. It is preferred that this charge be a uniform electrostatic charge over a uniform photoconductor surface. Such charging is done in the absence of light such that the projected optical images alter the electrostatic charge on the photoconductor surface of the drum 38 in preparation for image developing and transferring. In the case of FIG. 2 the beam 32 exposes the photoconductor surface of the drum 38. Light in the projected image electrically discharges the surface areas of the drum 38 in proportion to light intensity. With minimal light reflected from the dark or printed areas of an original document at the glass 16, there is no corresponding electrical discharge. As a result, an electrostatic charge remains in those areas of the photoconductive surface of the drum 38 corresponding to the dark or printed areas of the original document. This charge pattern is termed a "latent" image on the photoconductive surface of the drum 38.

The next xerographic station is a developer 42 which receives a toner (ink) from a toner supply to be deposited and retained on the photoconductive surface still having an electrical charge. The developer station 42 receives the toner with an electrostatic charge of a polarity opposite to that of the charged areas of the photoconductive surface. Accordingly, the toner particles adhere electrostatically to the charged areas, but do not adhere to the discharged areas. Hence, the photoconductive surface, after leaving developer station 42, has a toned image corresponding to the dark and light areas of an original document at the glass 16 or of the image supplied by a laser input from the printing arrangement shown in FIG. 4.

Next, the latent image is transferred to copy paper in a transfer station 44. The paper is brought to the station 44 from an input paper path portion 46 via a synchronizing input gate 48. In the transfer station 44, the copy paper is charged and brought into contact with the toned image on the photoconductive surface of the drum 38 which results in a transfer of the toner to the copy paper. After such transfer, the sheet of image bearing copy paper is stripped from the photoconductive surface of the drum 38 for transport along a path 50. Next, the paper has the electrostatically carried image fused thereon in a fusing station 52 for creating a permanent image on the copy paper. The copy paper receives electrostatic charges in the transfer station 44 which can have an adverse effect on copy handling. Accordingly, the copy paper is electrically discharged at a discharge station 54 before transfer to the output.

After the image area on the drum 38 leaves the transfer station 44, there is a certain amount of residual toner on the photoconductive surface. A cleaner station 56 has a rotating cleaning brush to remove the residual toner for cleaning the image area in preparation for receiving the next image projected onto the drum 38. The cycle then repeats by charging the just-cleaned image area at the charging station 40.

The copy-print production machine 12 has three different sources of paper sheets comprising a primary paper tray 58, a secondary paper tray 60 and a duplex paper tray 62. Any of the three trays 58, 60 and 62 is capable of responding to associated pickers (not shown) to provide sheets of paper along the input paper path portion 46 in well known fashion. The primary paper tray 58 serves as the primary or principal source of sheet paper for copying or printing operations. The secondary or auxiliary paper tray 60 provides the machine 12 with greater flexibility such as in instances where a paper of different size from that used in the primary tray 58 is to be made available. As is well known in the art the duplex paper tray 62 may be used for two sided copying or printing. A duplex diversion gate 64 is actuated to an upward position for deflecting single-image copies to travel over a path 66 to the duplex paper tray 62. The partially produced duplex copies (image on one side only) are stored in the next subsequent single-image run in which the copies receive the second image. In the next single-image run, the copies are removed, one at a time, from the duplex paper tray 62 and transported over the path portion 46 to the transfer station 44 for receiving a second image. The two-image duplex copies are then transferred to the output.

The manner in which sheets of paper are circulated from the trays 58, 60 and 62 are past the drum 38 to the output of the copy-print production machine 12 to effect copying or printing, can be better understood with reference to FIG. 3 which is a perspective view of the appropriate portions of the machine 12. As seen in FIG. 3 sheets of paper can be picked from any one of the three trays 58, 60 and 62 for transfer along the input paper path portion 46 into contact with the outer surface of the drum 38 in the region of the transfer station 44 (not shown in FIG. 3). From contact with the outer surface of the drum 38, the sheets of paper are transferred via the path 50 to the duplex diversion gate 64 which has the capability of directing a sheet of paper into the duplex paper tray 62. Otherwise the paper is transferred to either the copy exit tray 20 or the dual exit pocket 24. As previously noted, operation of the copy-print production machine 12 in a copy mode typically provides the copies to the copy exit tray 20 or the mechanical collator 22 shown in FIG. 1. Operation of the copy-print production machine 12 in the print mode normally causes routing of the printed sheets of paper to the dual exit pocket 24, with or without the benefit of electronic collation which is a capability of copier-printer systems such as the IBM 6670.

FIG. 4 shows the basic apparatus used in the print mode of operation of the copy-print production machine 12. A laser 70 emits a continuous beam of red light, a beam from which is deflected selectively by an acoustically modulated optical element 72. The beam from the laser 70 is reflected by mirrors 74 and 76 through spherical lenses 78 and 80 and to the acoustically modulated optical element 72. The spherical lenses 31 and 32 compress the laser beam to obtain adequate beam switching time. Spherical lenses 82 and 84 on the opposite side of the acoustically modulated optical element 72 from the spherical lenses 78 and 80 expand the size of the laser beam to obtain the necessary spot size on the photoconductive surface of the drum 38.

Figure 5:
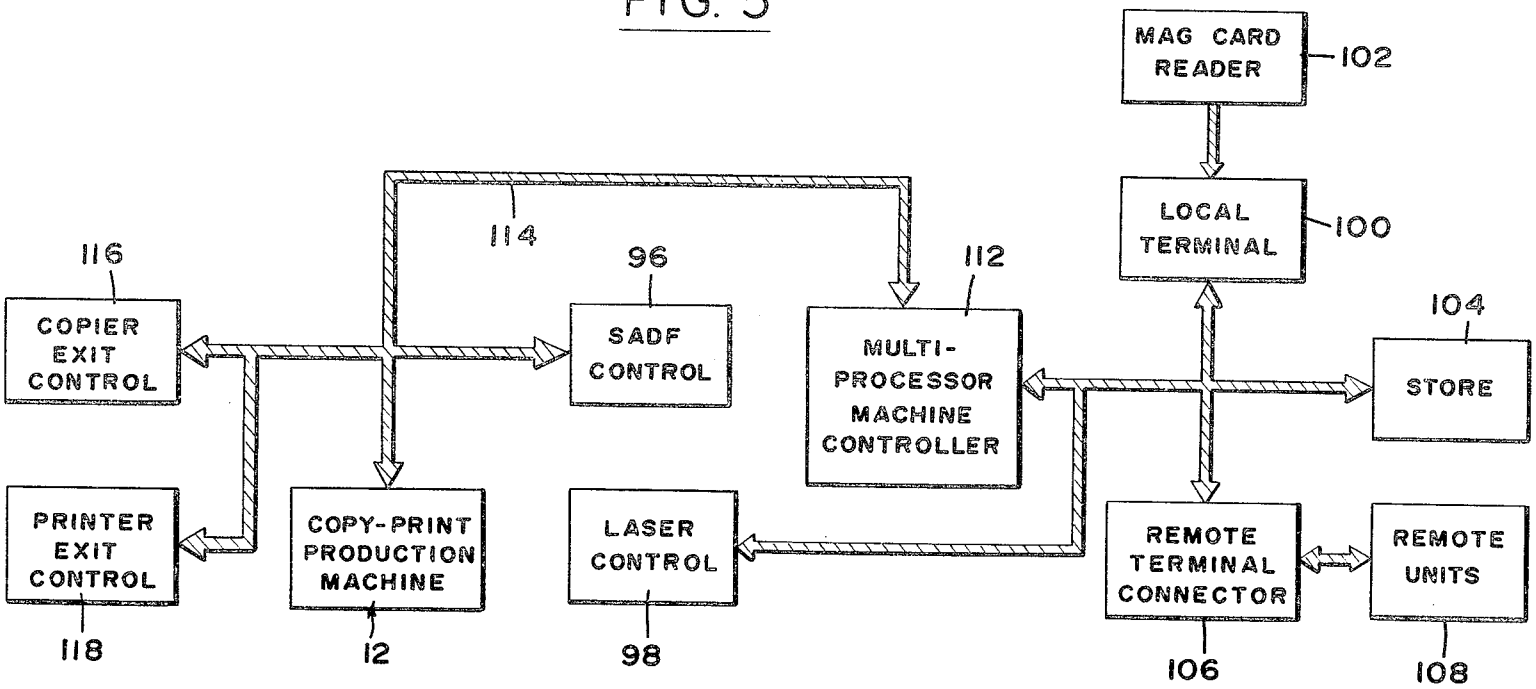
FIG. 5 is a block diagram of control circuits forming a part of the copier-printer system of FIG. 1.

The beam from the spherical lens 84 is deflected by a beam splitter 86 through a cylindrical lens 88. The direction of no power of the cylindrical lens 88 is perpendicular to the axis of rotation of a multifaceted mirror 90. After reflection from the mirror 90 the laser beam is reshaped as a slightly eliptical spot by a cylindrical lens 92 which is also oriented with its direction of no power perpendicular to the axis of rotation of the mirror 90. Cylindrical lenses 88 and 92 form a telescope in the direction of power of both elements which has been folded by the mirror 90, as described for example in U.S. Pat. No. 3,750,189. A spherical projection lens 94 focuses the laser beam onto the linear scan target on the xerographic drum. Lenses 92 and 94 combine to form a lens set which focuses the facets of the mirror 90 onto the xerographic drum 38 to compensate for facet angle errors. FIG. 5 illustrates the control circuits utilized in conjunction with the copy-print production machine 12 in the copier-printer system 10. The various control circuits are described in greater detail in the previously referred to co-pending application of Kuseski, and therefore are only briefly described herein. A plurality of image inputs are provided to the copy-print production machine 12 by an SADF control 96 and a laser control 98. The SADF control 96 includes a document scanning optical input in optical communication with a semiautomatic document feed as shown in FIG. 2. The laser control 98 which includes apparatus shown in FIG. 4 receives word processing indicating signals for creating an optical image.

The laser control 98 can receive signals from a local terminal 100 which is a word processing terminal for receiving word processing signal-bearing magnetic cards at an associated mag card reader 102. Signals from the local terminal 100 are temporarily stored in a non-volatile store 104. Additionally, for communication in an imge communication network, a remote terminal connector 106 provides signal communication to various remote units 108. The word processing signals from the local terminal 100 are initially stored in a page buffer 110 shown in FIG. 6 and forming a part of a multiprocessor machine controller 112. The controller 112 effects transfer of the signals to the laser control 98 for generating an image to be transferred to the copy-print production machine 12.

The multiprocessor machine controller 112 controls all units in the copier-printer system 10. The various closely controlled units such as the laser control 98, the store 104, the remote terminal connector 106 and the local terminal 100 are controlled by pairs of unidirectional buses as described in the previously referred to co-pending application of Kuseski. The other units are those related to copy production. Communication is by way of a bidirectional data bus 114 shown connected to a copier exit control 116, a printer exit control 118, the copy-print production machine 12 and the SADF control 96. The printer exit control 118 directs each printed page to the dual exit pocket 24. The copy-print production machine 12 directs each copied page to the exit tray 20, the mechanical collator 22 or the duplex paper tray 62.

The multiprocessor machine controller 112 is shown and described in detail in the previously referred to co-pending application of Kuseski. As described in that application the multiprocessor machine controller 112 has a production machine controlling subsystem which includes a system microprocessor for executing a set of control programs contained in a control store with the page buffer 110 shown in FIG. 6 being used as a main or working store. A separate copy production machine controlling subsystem within the multiprocessor machine controller 112 communicates with the various units in the production machine controlling subsystem via various data transfer buses and includes a copy microprocessor, a control store containing programs, a working store for use as a main memory and input/output registers.

Figure 6:
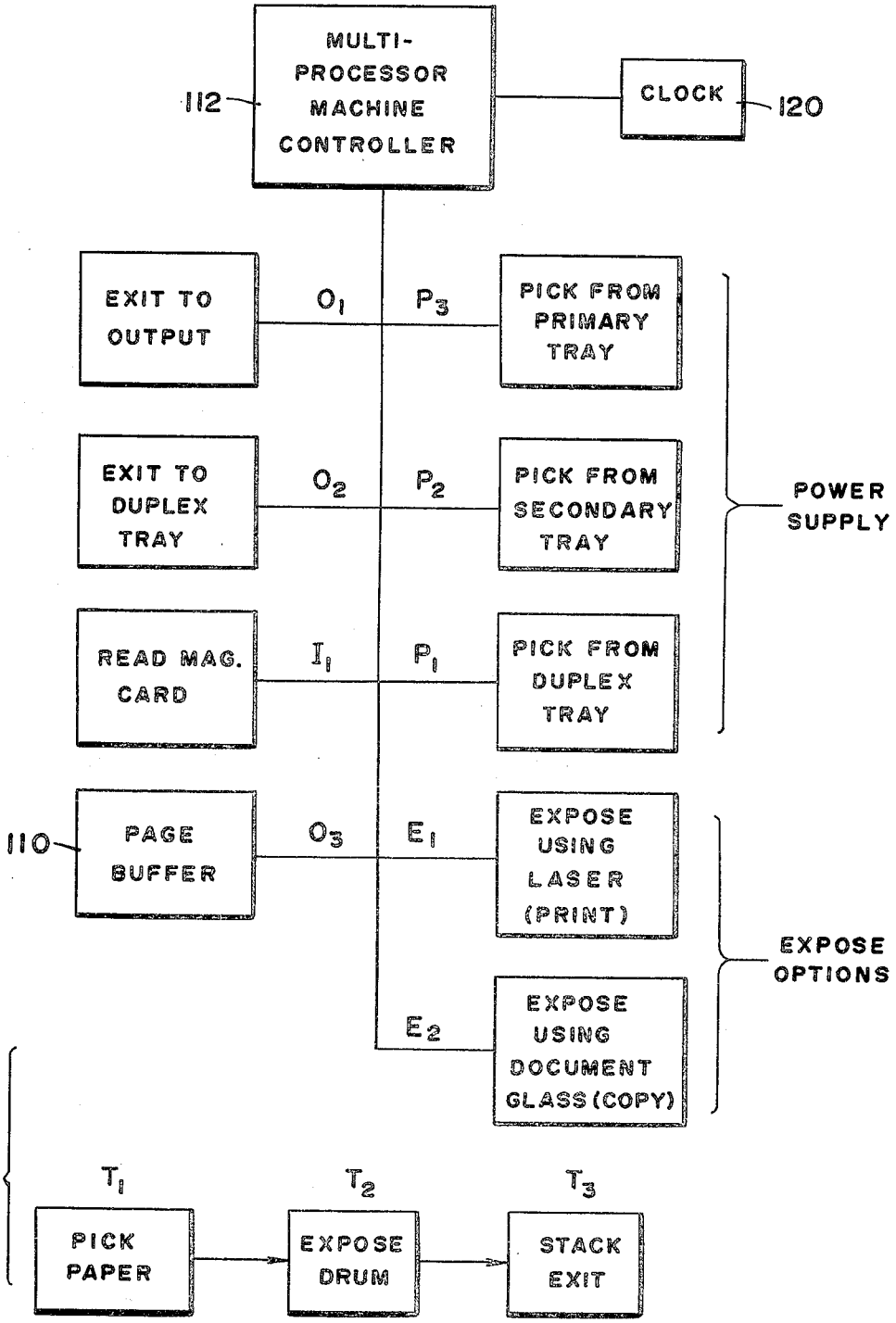
FIG. 6 is a block diagram of a multiprocessor machine controller used in the control circuits of FIG. 5.

As described in the Kuseski application, the multiprocessor machine controller 112 is capable of executing various functions including the various functions shown in FIG. 6. The controller 112 which is coupled to a clock 120 to synchronize the operation of the memories therein is for each copy or printed page capable of selecting one of three different sources of paper supply designated $P_1$, $P_2$ and $P_3$. $P_1$ represents the function in which the controller 112 causes an associated picker to pick a sheet of paper from the duplex paper tray 62 shown in FIGS. 2 and 3. $P_2$ represents the removal of a sheet of paper from the secondary or auxiliary paper tray 60. $P_3$ corresponds to the picking of a sheet of paper from the primary paper tray 58.

The multiprocessor machine controller 112 is also capable of choosing between two different expose options designated $E_1$ and $E_2$ in FIG. 6. $E_2$ designates the expose option in which the copy-print production machine 12 operates in the copy mode and uses the apparatus shown in FIG. 2 to copy an original document at the document glass 16 onto a sheet of paper selected from one of the paper trays 58, 60 and 62. $E_1$ defines the print mode of operation of the machine 12 in which the laser apparatus shown in FIG. 4 is used to print coded information from the store 104 or other source on a sheet of paper selected from the paper trays 58, 60 and 62.

As shown in FIG. 6 the multiprocessor machine controller 112 is capable of performing still other functions designated $O_1$, $O_2$, $I_1$ and $O_3$. $O_1$ represents an exit of the sheet paper from the copy-print production machine 12 past the duplex diversion gate 64 to the copy exit tray 20, the mechanical collator 22 or the dual exit pocket 24. $O_2$ represents the other alternative in which the exiting sheet of paper is directed by the duplex diversion gate 64 into the duplex paper tray 62. $I_1$ represents the function in which a magnetic card present in the mag card reader 102 is read to determine instructions or coded information to be printed. $O_3$ represents the function in which information stored in the page buffer 110 is retrieved therefrom for printing.

FIG. 6 also depicts the various functions capable of being performed by the multiprocessor machine controller 112 in terms of three different times $T_1$, $T_2$ and $T_3$. During each cycle of the copy-print production machine 12, the machine picks a sheet of paper from one of the paper supply trays at a time $T_1$. The machine does this by performing $P_1$, $P_2$ or $P_3$. Next, the machine 12 exposes the drum 38 at a time $T_2$ so as to perform one of the expose options $E_1$ and $E_2$. Thereafter, as the image from the drum is transferred onto the sheet of paper, the sheet of paper exits the machine 12 at a time $T_3$ with functions $O_1$ or $O_2$ being performed. In accordance with the invention non-coded information copied from original documents presented at the document glass 16 is merged with coded information from the store 104 by providing for two different passes of at least one sheet of paper of a given document through the copy-print production machine 12. This is accomplished by picking one or more sheets of paper from the primary paper tray 58 and copying non-coded information thereon from original documents at the document glass 16 to form the pages of a given document which are to contain non-coded information. These sheets of paper are collected and then placed in the secondary paper tray 60 or the duplex paper tray 62 depending upon the particular method being used. The copier-printer system 10 is then used to print the coded information of the document. Pages containing only coded information are printed on fresh sheets of paper picked from the primary paper tray 58. Other pages having non-coded information already copied thereon are picked from either the secondary paper tray 60 or the duplex paper tray 62 and cycled through the machine 12 a second time with coded information being printed thereon as required. Such operations are controlled by the mag card reader 102 in response to information contained on one or more mag cards. The mag cards indicate which pages of the document contain non-coded information, the location of the non-coded information and some or all of the coded information to be printed in the document. Accordingly, the mag cards are used to determine paper supply during printing of the coded information as well as the locations on the various sheets of paper where the coded information is to be printed.

A typical page of a document containing merged non-coded and coded information is shown in FIG. 7A. A top portion 130 of the page is comprised of text which is typically printed from coded information. A middle portion 132 of the page depicts a graph 134 which is non-coded information that must be copied on the page. A bottom portion 136 of the page is comprised of further text which is typically printed from coded information. In accordance with the invention the page shown in FIG. 7A is made up on a sheet of paper 138 by selecting the sheet of paper 138 from the primary paper tray 58 and cycling it through the machine 12 while copying the graph 134 thereon from an original document containing the graph at the document glass 16. The sheet of paper 138 is then placed in the secondary paper tray 60 or the duplex paper tray 62 from which it is picked and sent through a second cycle in the machine 12 during which the text is printed at the top portion 130 and the bottom portion 136.

The process of making the page shown in FIG. 7A is controlled by one or more mag cards, one of which is shown in FIG. 7B. The particular mag card 140 shown in FIG. 7B contains a non-coded information identifier indicating that the particular page of FIG. 7A contains non-coded information. The mag card 140 may also contain some or all of the coded information to be printed on the page of FIG. 7A. At the very least, the mag card 140 contains coded information peculiar to the non-coded information on the page of FIG. 7A such as legends, labels and figure numbers. The mag card 140 also typically contains the coded information to be printed on the top portion 130 and the bottom portion 136 of the page of FIG. 7A. Finally, the mag card 140 of FIG. 7B contains coded information formatting the positioning information indicating the location of the non-coded information 134 on the page of FIG. 7A or in any event the areas of the page where the coded information is to be printed and which are therefore in a separate location from the non-coded information 134.

The mag card 140 of FIG. 7B can be prepared prior to or as part or the process of copying the non-coded information 134 on the sheet of paper 138. Thereafter, the mag card 140 is entered in the mag card reader 102 and the sheet of paper 138 is placed in the secondary paper tray 60 or the duplex paper tray 62. During the subsequent printing of the document, the mag card 140 first of all identifies that the particular page of the document shown in FIG. 7A has non-coded information copied thereon. This results in a multiprocessor machine controller 112 selecting the appropriate one of the papers trays 60 and 62 to pick the sheet of paper 138 for cycling through the copy-print production machine 12. As the sheet of paper 138 is cycled through the machine 12, the coded information stored on the mag card 140 is printed on the top portion 130 and the bottom portion 136 under the control of the coded information formatting and positioning information which is also contained on the mag card 140 and which indicates the proper locations for the coded data to be printed. The non-coded information identifier on the mag card 140 can comprise any conventional identifying information such as an eject code commonly used on the mag cards to initiate a particular process in a copier-printer system. The coded information formatting and positioning information can comprise information conventionally used in connection with the mag cards to perform a positioning or spacing function such as a character return function. The coded information is recorded on the mag cards in the usual fashion. Mag cards such as the card 140 can also be used to control the copying of non-coded information during the first paper pass where the copier-printer system 10 is equipped with an automatic document feeder. In other cases where the copier-printer system 10 is equipped with a semiautomatic document feeder, copying of the non-coded information is manually controlled.

FIG. 8 depicts the successive steps in one preferred method of merging non-coded information and coded information in accordance with the invention. In a first step designated 142, mag cards are prepared in the manner just described in connection with FIGS. 7A and 7B. One approach is to prepare a separate mag card for each page in the document. If this is done the mag card corresponding to each page containing only matter printed from coded information contains only the coded information. However, cards corresponding to pages containing non-coded information exclusively or in combination with coded information contain a non-coded information identifier and coded information formatting and positioning information in addition to any coded information which is to be printed on the page. During the printing phase of preparing the document the mag card corresponding to each new page is examined for the presence of a non-coded information identifier, and if one is present a sheet of paper is selected from other than the primary paper tray 58. The coded information formatting and positioning information is then used by the multiprocessor machine controller 112 to determine the locations where the coded information on the card is printed on the sheet of paper. If examination of a mag card fails to produce a non-coded information identifier, thereby signaling a page which is to contain exclusively coded information, the controller 112 proceeds to print the coded information contained on the card on the top of a sheet of paper picked from the primary paper tray 58.

In a second step designated 144 in FIG. 8 the mag cards which were prepared in the first step 142 are arranged in proper sequence in preparation for the printing phase of the process. Again, this example assumes that a separate card has been prepared for each page. While this is convenient from the standpoint of the operator being able to prepare mag card information for each page independent of the other pages of the document, it is not essential that this procedure be followed. Thus, the necessary information for many pages can be contained on one or only a few mag cards, assuming that the information can be entered on the cards in order and without waste of substantial storage space on each card.

During a next step designated 146 in FIG. 8, non-coded information is copied onto sheets of paper from the primary tray 58 in proper sequence and with the desired number of copies of each page being made. This is done manually by an operator using the copier-printer system 10 in conventional copy mode fashion, although as mentioned previously mag cards can be used to control this operation where the copier-printer system 10 is equipped with an automatic document feeder. The first page of the document to contain non-coded information is made by placing the original document containing the non-coded information on the document glass 16 and setting the quantity selector 28 to correspond to the desired number of copies of the document. The copier-printer system 10 is then operated in conventional copy mode fashion to make the desired number of copies of the first page to contain non-coded information. This procedure is then repeated for subsequent pages of the document containing non-coded information. The next step designated 148 in FIG. 8 is actually performed as a part of the step 146. As the copies of the non-coded information are being made, the copier-printer system 10 is adjusted so as to provide the electronic collation as well as turnaround or inversion of each copy in the collator. Both electronic collation and turnaround can be performed in the IBM 6670 by operator actuation of a couple of switches. When this operation is completed, the collator bins contain one copy of each original in inverse order. Thus the copy of the first original is in the bottom of the bin, toner side up, and the copy of the last original is in the top of the bin, toner side up.

During a next step 150 in the method of FIG. 8 the copies are removed from the collator bins and piled into one stack. This stack is then inverted and placed in the secondary paper tray 60 so that the toner side of each sheet of paper is down.

During a next step designated 152 in FIG. 8 the mag cards which are prepared in the step 142 are used to control printing of coded information. Pages containing only coded information are printed on sheets of paper selected from the primary paper tray 58, while pages containing non-coded information are selected from the stack of copies previously placed in the secondary paper tray 60. During the print mode of operation, electronic collation is again used so that a first copy of the document is made with all of the pages thereof in proper sequence, followed by the second copy of the document and so on. As the sheets of paper are cycled through the machine 12 during the print mode, they are caused to exit to the dual exit pocket 24. During a final step 154 in the method of FIG. 8 the different sets of copies of the document are collated in the dual exit pocket 24 and then removed therefrom.

The various functions performed by the multiprocessor machine controller 112 in carrying out the method of FIG. 8 are shown at the top of FIG. 11 at the three different times $T_1$, $T_2$ and $T_3$. During the copy mode $P_3$ is chosen automatically by operating the copier-printer system 10 in conventional copy mode fashion. This also results in selection of $E_2$ to expose the original documents at the document glass 16 and the selection of $O_1$ causing the copies to exit to one of the outputs rather than to the duplex tray 62. During the print mode which is preceded by inverting and loading the stack of copies from the output in the secondary paper tray 60, the mag cards dictate either $P_2$ or $P_3$ at $T_1$, depending on whether each page contains non-coded information or not. The mag cards also cause the copier-printer system 10 to operate in the print mode with coded information from the mag cards or other appropriate source being used to print on the paper copies in conventional fashion. At $T_3$ the printed copies exit to the dual exit pocket 24.

In the alternative method shown in FIG. 9, the first three steps of such method are identical to the steps 142, 144 and 146 of the method shown in FIG. 8. However, the making of copies in step 146 is done with the control button for the duplex paper tray 62 pushed so that the duplex diversion gate 64 diverts the outgoing copies for collection in the duplex paper tray 62. This is noted in a step 156 in FIG. 9. The copying is done with the electronic collator turned off so that copies of the first page of non-coded information are contained at the bottom of the duplex paper tray 62 with copies of the next page stacked on top thereof, and so on.

The copies enter and are stored in the duplex paper tray 62 toner side up. It is therefore necessary to invert the copies before the print mode of operation can take place. This is accomplished by picking each copy out of the duplex paper tray 62 and passing it through a dummy cycle and back to the duplex paper tray 62 to invert the copies as noted in a next step 158 in FIG. 9. The dummy cycle is accomplished by turning off the charge corona and transfer corona of the copy-print production machine 12. No printing of coded information is done on the sheets during the dummy cycle, the sole purpose of such cycle being to invert each sheet in the duplex paper tray 62.

The dummy cycle can be avoided if the copier-printer system 10 is equipped with paper inverting apparatus, as is the case with both the IBM Series III and IBM 6670 with collator. Such apparatus, an example of which is provided by U.S. Pat. No. 2,901,246 of Wagner, is inserted in the paper path upstream of the duplex tray and perform the function of inverting the sheets of paper having non-coded information copied thereon during the first pass thereof through the copier-printer system 10.

After each sheet has passed through the dummt cycle and has been returned to the duplex paper tray 62, or has otherwise been inverted, the print mode of operation is begun. This is noted as a step 160 in the method of FIG. 9. The step 160 of FIG. 9 is like the step 152 of FIG. 8 except that the non-coded information pages are picked from the duplex paper tray 62 rather than the secondary paper tray 60. In addition, the print mode is not carried out using electronic collation. Instead, the requisite number of copies of each page is made before going on to print the next page. The various printed copies are then collated into sets of copies using the mechanical collator 22 shown in FIG. 1 as noted in the next and final step 162 in the method of FIG. 9.

The example of FIG. 9 in terms of functions performed by the multiprocessor machine controller 112 is shown in the middle portion of FIG. 11. During the copying mode of operation, the same functions are selected at $T_1$ and $T_2$ as in the case of FIG. 8. However, at $T_3$ the copies exit to the duplex tray following the function $O_2$ because the duplex button is pressed. During the next or dummy cycle, each copy in the duplex paper tray is picked from the tray at $T_1$. At $T_2$ neither of the expose options $E_1$ and $E_2$ is chosen since no copying or printing is to be done. At $T_3$ the copy is returned to the duplex paper tray. During the print mode, paper is picked from the primary paper tray ($P_3$) or the duplex paper tray ($P_1$), depending on whether each page contains non-coded information or not. The functions at $T_2$ and $T_3$ are the same as in the example of FIG. 8.

A further alternative method in accordance with the invention is shown in FIG. 10. The first two steps of the method of FIG. 10 are the same as the steps 142 and 144 of the method of FIG. 8. In a third step 164 one copy only of each page containing non-coded information is made by placing the original documents in sequence on the document glass 16. The resulting sheets of paper are cycled to the exit tray 20 where, when collected, they form one copy of each page of the document containing non-coded information. This is noted in the next step 166 in FIG. 10.

In a next step 168 shown in FIG. 10 the stack of copies collected in the exit tray 20 is removed, inverted and placed in the secondary paper tray 60. Inversion of the stack results in each sheet being placed toner side down in the secondary paper tray 60. Consequently, each sheet when picked from the secondary paper tray 60 is properly oriented to present the toner side for printing thereon when contacting the drum 38.

During a next step 170 shown in FIG. 10 the mag cards prepared and arranged in the first two steps are used to control the printing of coded information. Only one copy of each page of the document is made at this point. Pages of the document containing only coded information are printed on sheets of paper taken from the primary paper tray 58. Pages of the document containing non-coded information are selected from the secondary paper tray 60 with coded information being printed thereon as required during the second pass thereof through the copy-print production machine 12. When this step is complete the dual exit pocket 24 contains one set of copies of the document. During the final step designated 172 in FIG. 10 the set of copies is used as a set of originals to make the desired number of copies of the document. Thus, each page of the set of copies is placed on the document glass 16 and a requisite number of copies made thereof. The copies at the output are directed into the mechanical collator 22 which collates the copies into the desired sets of copies of the document.

Referring to the bottom portion of FIG. 11 it will be seen that in the method of FIG. 10 the process of copying the non-coded information involves the same functions $P_3$, $E_2$ and $O_1$ as in the methods of FIGS. 8 and 9. Likewise, the printing of coded information involves the same functions $P_2$ or $P_3$, $E_1$ and $O_1$ as in the print modes of operation of the methods of FIGS. 8 and 9. In the final step of the method of FIG. 10 the functions $P_3$, $E_2$ and $O_1$ of the first part of the method of FIG. 10 are repeated as the desired number of copies of the document are made.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A method of merging coded and non-coded information in a xerographic copier-printer comprising the steps of:

copying non-coded information onto a given side of a sheet of paper during a first pass of the sheet of paper through the xerographic copier-printer; and printing coded information onto the given side of the sheet of paper during a subsequent pass of the sheet of paper through the xerographic copier-printer.

2. The invention set forth in claim 1, wherein the copying of the non-coded information is performed on each of a plurality of different sheets of paper during a first pass of the different sheets of paper through the xerographic copier-printer, and the printing of the coded information is performed on each of the plurality of different sheets of paper during a subsequent pass of the different sheets of paper through the xerographic copier-printer.

3. A method of merging first and second groups of information in a xerographic copier-printer comprising the steps of preparing a record member to represent the kind and location of information to be placed on the sheet of paper, copying a first group of information onto a sheet of paper under the control of the record member during a first pass of the sheet of paper through the xerographic copier-printer and printing a second group of information onto the sheet of paper under the control of the record member during a subsequent pass of the sheet of paper through the xerographic copier-printer.

4. The invention set forth in claim 3, wherein the first group of information comprises non-coded information and the record member comprises a magnetic card containing a non-coded information identifier and formatting and positioning information for the non-coded information.

5. A method of making a multi-page document containing coded information and having at least one page containing non-coded information, comprising the steps of:

providing a copier-printer having a primary paper tray, a secondary paper tray, an output bin and an arrangement for selectively inverting paper prior to entry into the output bin;

copying non-coded information onto at least one sheet of paper from the primary paper tray using the copier-printer;

inverting the at least one sheet of paper prior to entry into the output bin of the copier-printer;

removing the at least one sheet of paper from the output bin and placing it in the secondary paper tray of the copier-printer; and printing coded information on a plurality of sheets of paper in sequence using the copier-printer to form a multi-page document, pages of the document containing only coded information being printed on paper taken from the primary paper tray and pages of the document containing non-coded information being comprised of the at least one sheet of paper taken from the secondary paper tray.

6. The invention set forth in claim 5, wherein the step of printing coded information includes taking the at least one sheet of paper from the secondary paper tray and printing coded information thereon.

7. The invention set forth in claim 5, wherein the step of copying non-coded information onto at least one sheet of paper from the primary paper tray comprises sequentially copying non-coded information onto a plurality of sheets of paper from the primary paper tray to form a desired number of sets of copies of the non-coded information, the sets of copies being provided by electronic collation within the copier-printer and being presented as sets with each page thereof inverted at the output bin, the step of removing the at least one sheet of paper from the output bin and placing it in the secondary paper tray comprises removing the sets of copies from the output bin and placing them in the secondary paper tray, and the step of printing coded information comprises printing the coded information on the first set of copies in the secondary paper tray with any pages containing only coded information being printed on paper taken from the primary paper tray to form a first set of copies of the multi-page document and repeating for each set of copies stored in the secondary paper tray.

8. The invention set forth in claim 5, wherein the copier-printer has a magnetic card reader for controlling printing, and further comprising the step of preparing at least one magnetic card to represent the pages of the multi-page document, the magnetic card including a non-coded information identifier and information representing the location of non-coded information for each page to have non-coded information copied thereon, the step of printing coded information including using the card reader and the at least one card to select the paper tray from which each sheet of paper is taken and to control the copying and printing of information on the sheets of paper.

9. The method of making a multi-page document containing coded information and having at least one page containing non-coded information, comprising the steps of:

providing a copier-printer having a primary paper tray and a duplex paper tray;

repeatedly copying non-coded information onto sheets of paper from the primary paper tray to form a desired number of copies of at least one page containing non-coded information using the copier-printer, the copies being stored in the duplex paper tray of the copier-printer;

inverting each copy stored in the duplex paper tray by cycling the copy through the copier-printer without copying or printing thereon and returning the copy to the duplex paper tray; and printing coded information on a plurality of sheets of paper using the copier-printer to form a desired number of sets of copies of a multi-page document, pages of the document containing only coded information being printed on paper taken from the primary paper tray and pages of the document containing non-coded information being comprised of the at least one page, the copies of which are comprised of paper taken from the duplex paper tray.

10. The invention set forth in claim 9, wherein the step of printing coded information includes taking sheets of paper from the duplex paper tray and printing coded information thereon to form copies of the at least one page.

11. The invention set forth in claim 9, wherein the step of repeatedly copying non-coded information comprises repeatedly copying non-coded information onto sheets of paper from the primary paper tray to form a desired number of copies of a first page containing non-coded information using the copier-printer and repeating as necessary to form a desired number of copies of a second and subsequent pages containing non-coded information using the copier-printer, and the step of printing coded information includes printing coded information on paper taken from the duplex paper tray to form the desired number of copies of each page of the document containing non-coded information.

12. The invention set forth in claim 9, wherein the copier-printer has a magnetic card reader for controlling printing, and further comprising the step of preparing at least one magnetic card to represent the pages of the multi-page document, the magnetic card including a non-coded information identifier and information representing the location of non-coded information for each page to have non-coded information copied thereon, the step of printing coded information including using the card reader and the at least one card to select the paper tray from which each sheet of paper is taken and to control the copying and printing of information on the sheets of paper.

13. A method of making a multi-page document containing coded information and having at least one page containing non-coded information, comprising the steps of:

providing a copier-printer having a primary paper tray, a secondary paper tray and an output bin;

copying non-coded information onto at least one sheet of paper from the primary paper tray using the copier-printer to form a copy of a page containing non-coded information, the copy being passed to the output bin;

removing the copy from the output bin and placing it in the secondary paper tray of the copier-printer;

printing coded information on a plurality of sheets of paper in sequence to form a set of copies of a multi-page document using the copier-printer, pages containing only coded information being printed on paper taken from the primary paper tray and pages containing non-coded information being comprised of paper taken from the secondary paper tray; and using the set of copies of the multi-page document formed by the prior step to make further sets of copies of the multi-page document as desired using the copier-printer.

14. The invention as set forth in claim 13, wherein the step of copying non-coded information comprises copying non-coded information onto a plurality of sheets of paper from the primary tray in sequence to form a copy of each of a plurality of pages containing non-coded information and the step of removing the copy from the output bin comprises removing the copy of each of the plurality of pages containing non-coded information from the output bin and placing the copy in the secondary paper tray of the copier-printer.

15. The invention set forth in claim 13, wherein the copier-printer has a magnetic card reader for controlling printing, and further comprising the step of preparing at least one magnetic card to represent the pages of the multi-page document, the magnetic card including a non-coded information identifier and information representing the location of non-coded information for each page to have non-coded information copied thereon, the step of printing coded information including using the card reader and the at least one card to select the paper tray from which each sheet of paper is taken and to control the copying and printing of information on the sheets of paper.

* * * * *